US006364138B1

(12) United States Patent
Chen

(10) Patent No.: US 6,364,138 B1
(45) Date of Patent: Apr. 2, 2002

(54) SECTIONAL RACK

(75) Inventor: Henry Chen, Taipei (TW)

(73) Assignee: Protrend Co., Ltd., Taipei (TW)

( * ) Notice: Subject to any disclaimer, the term of this patent is extended or adjusted under 35 U.S.C. 154(b) by 0 days.

(21) Appl. No.: 09/650,459

(22) Filed: Aug. 28, 2000

(51) Int. Cl.[7] ..... A47B 57/34

(52) U.S. Cl. ..... 211/187; 211/181.1; 211/182; 108/147.13; 108/147.15

(58) Field of Search ..... 211/187, 181.1, 211/182; 108/106, 107, 144.11, 147.11, 147.12, 147.13, 147.15

(56) References Cited

U.S. PATENT DOCUMENTS 4,582,001 A * 4/1986 Leikarts ..... 211/187 X
4,593,826 A * 6/1986 Bustos ..... 211/187
4,656,952 A * 4/1987 Schweizer ..... 248/188 X
5,004,198 A * 4/1991 Jager ..... 248/224.8
5,482,238 A * 1/1996 Kreiter ..... 211/183 X
D382,736 S * 8/1997 Kopish ..... D6/495
6,068,143 A * 5/2000 Wang ..... 211/187
6,257,426 B1 * 7/2001 Masunaka et al. ..... 211/187

* cited by examiner

*Primary Examiner*—Daniel P. Stodola
*Assistant Examiner*—Erica B. Harris
(74) *Attorney, Agent, or Firm*—W. Wayne Liauh

(57) ABSTRACT

A sectional rack includes a plurality of vertical posts, a plurality of horizontal shelves, and a plurality of connecting members. Each of the vertical posts is a hollow post and has a generally I-shaped cross section with two substantially rectangular and width-expanded side portions and a width-narrowed middle portion extending between the two side portions. The horizontal shelves are connected to the two side portions of the vertical posts so that two adjacent shelves located at two sides of the post are at the same height.

7 Claims, 9 Drawing Sheets

SECTIONAL RACK

BACKGROUND OF THE INVENTION

The present invention relates to a sectional rack, and more particularly to a sectional rack including vertical posts having an I-shaped cross section to allow horizontal shelves to connect to two lateral sides of the posts at the same height.

Sectional furniture has the advantages of easy storage and easy conveyance. However, the sectional furniture, after being assembled, does not always meet the space available in a room for the furniture. Consumers would apparently select sectional furniture that may be freely assembled to meet available space, and it appears that sectional racks and sectional cabinets could most satisfy the consumers' need.

A sectional rack, developed at an early stage, uses fastening means to screw all components of the sectional rack together. These fastening means require tools to tighten them and therefore complicate the assembling of the sectional rack and cause inconvenience to the consumers. There is now a commercially available sectional rack including metal posts 10. The metal posts 10 are provided along their length with a plurality of vertically spaced annular grooves 13. Horizontal shelves 12 are connected to the posts 10 by engaging four short sleeves 14 provided at four corners of the shelves 12 with the posts 10. FIG. 1 is a sectional rack 1 assembled from such posts 10 and shelves 12. Please now refer to FIGS. 2 and 3. The shelf 12 is connected to the post 10 via an openable connecting member 11. U.S. Pat. Nos. 5,676,263; 5,303,645; 5,174,676; 4,991,725; 4,799,818; 4,595,107; 4,546,887; and 4,763,799 all disclose sectional racks having structure similar to that shown in FIGS. 1 to 3.

When the sectional rack 1 is to be horizontally extended, two laterally adjacent shelves 12 must be connected to the same two posts by sequentially putting their short sleeves 14 around the posts 10. That is, any two laterally adjacent shelves 12 could not be located on the posts 10 at the same height, and there is a difference in height between them. This makes the assembled sectional rack 1 visually unbalanced and not convenient for holding things.

It is therefore desirable to develop a sectional rack of which horizontally adjacent shelves could be supported on the posts at the same height to provide horizontally freely extendable areas on the rack.

SUMMARY OF THE INVENTION

A sectional rack according to the present invention includes a plurality of vertical posts, a plurality of horizontal shelves, and a plurality of connecting members. Each of the vertical posts is a hollow post and has a generally I-shaped cross section with two substantially rectangular and width-expanded side portions and a width-narrowed middle portion extending between the two side portions. The horizontal shelves are connected to the two side portions of the vertical posts so that two adjacent shelves located at two sides of the post are at the same height, making the rack assembled from the shelves and the posts visually balanced and more attractive.

The connecting member of the present invention has a generally U-shaped cross section suitable for embracing one side portion of the post. And, the shelf of the present invention has short sleeves provided at four corners thereof. These short sleeves have a generally U-shaped cross section suitable for each embracing a connecting member, so that the connecting member is downward and inward compressed by the U-shaped short sleeve to firmly attach to the post and support the shelf on the post.

The U-shaped short sleeves of the shelves allow two laterally adjacent shelves to be horizontally connected to two side portions of the posts at the same height.

The posts of the sectional rack of the present invention are provided at their two side portions with a plurality of spaced horizontal slots or grooves for receiving a plurality of ribs provided at inner surfaces of the connecting members, so that the connecting members can be firmly attached to the posts by engagement of the ribs with the slots or grooves.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENTS

Figure 1:
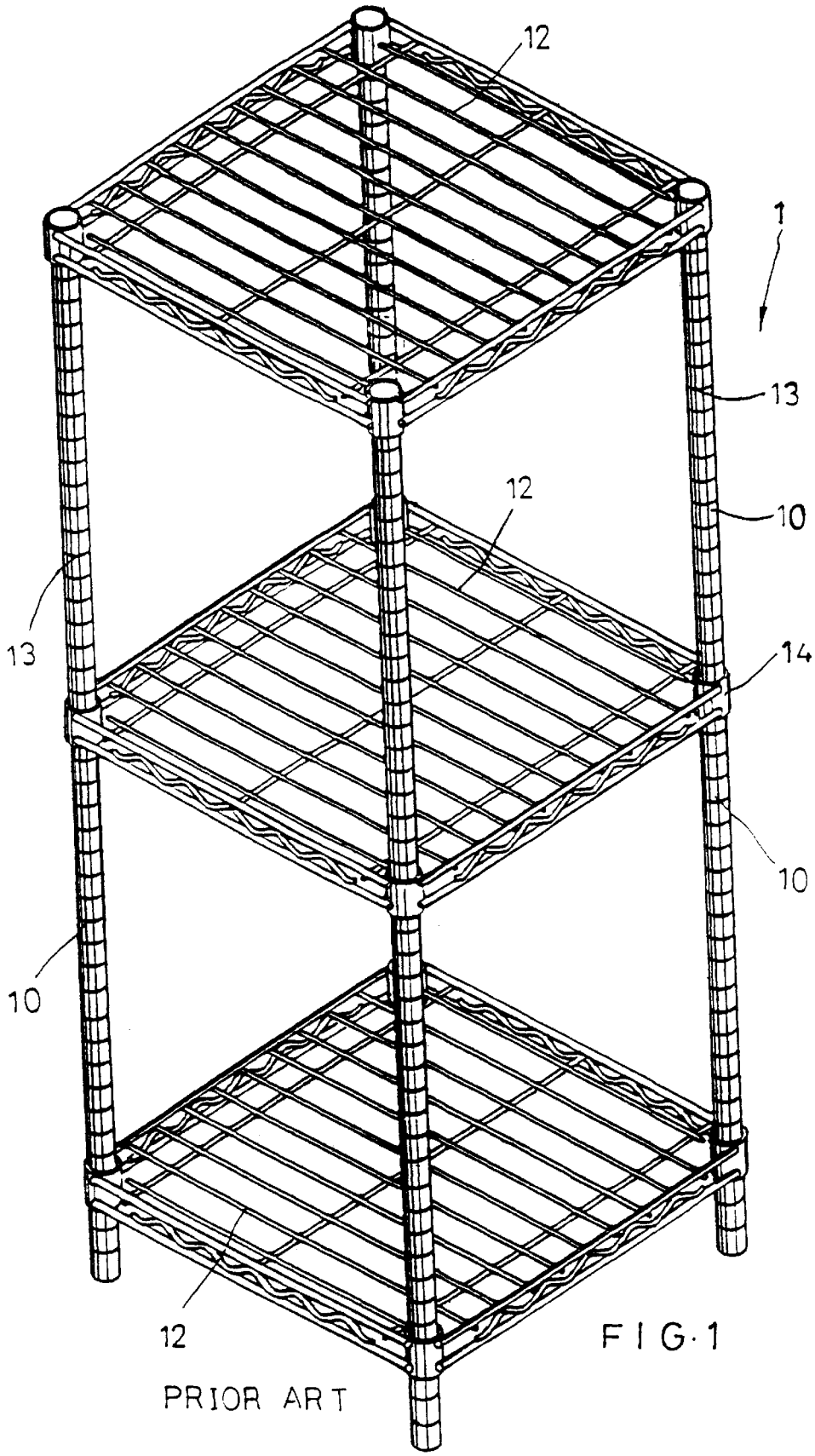
FIG. 1 PRIOR ART
FIG. 1 is an assembled perspective of a conventional sectional rack having vertical posts provided with a plurality of vertically spaced annular grooves.
Figure 2:
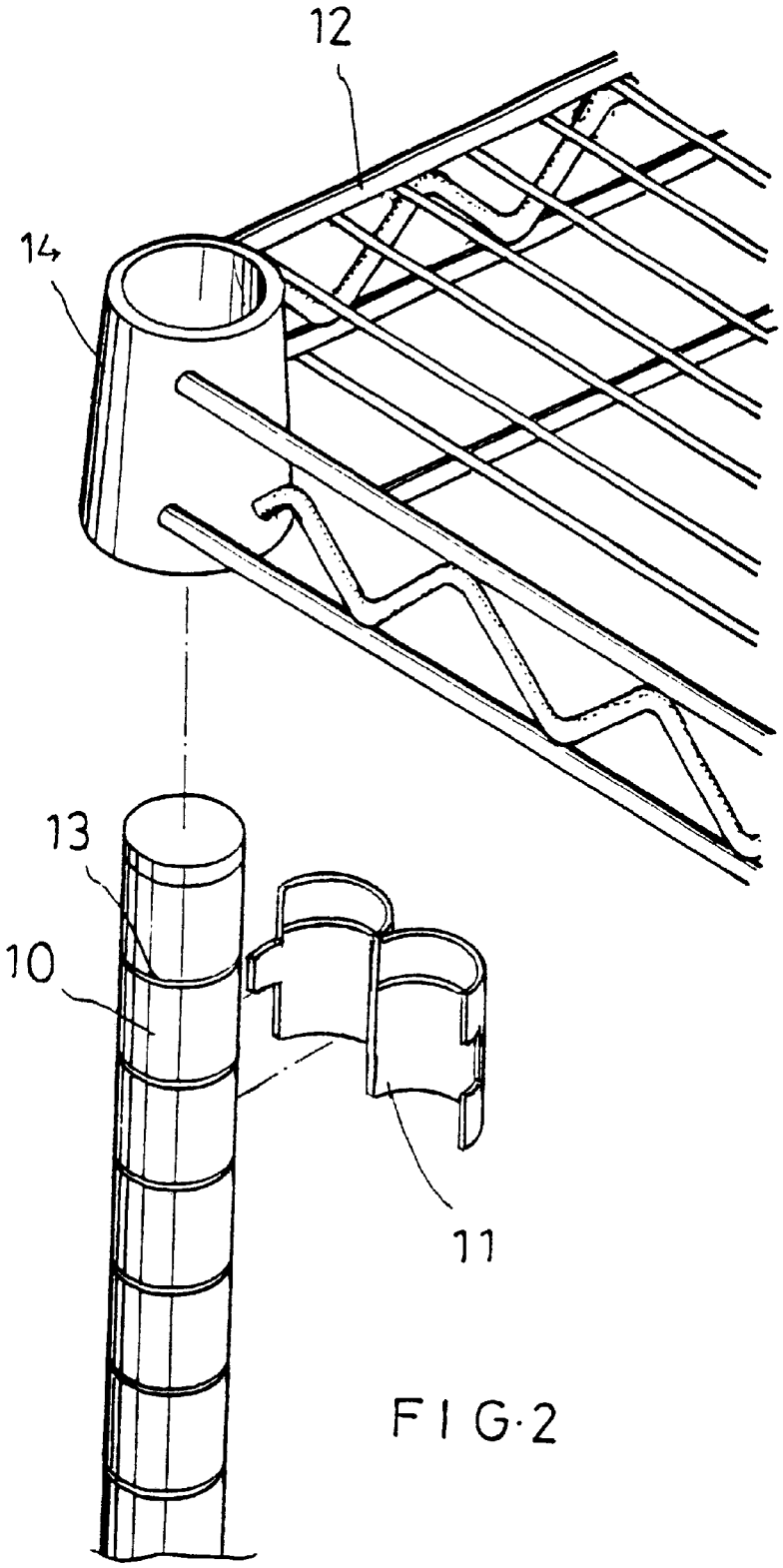
FIG·2 PRIOR ART
FIG. 2 is a fragmentary, enlarged and exploded perspective of the sectional rack of FIG. 1.
Figure 3:
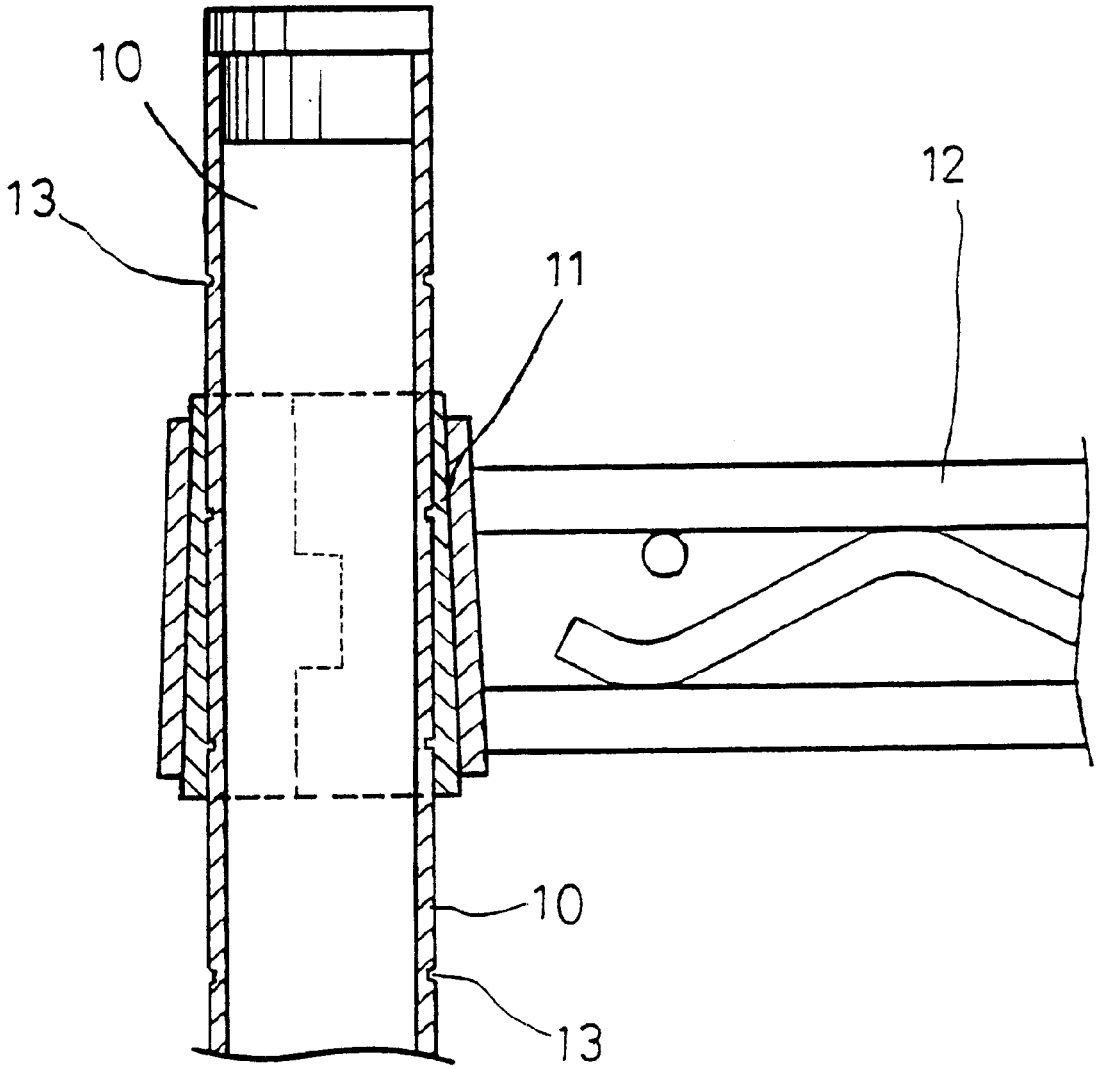
PRIOR ART FIG·3
FIG. 3 is a fragmentary, enlarged and assembled sectional view of the sectional rack of FIG. 1.
Figure 4:
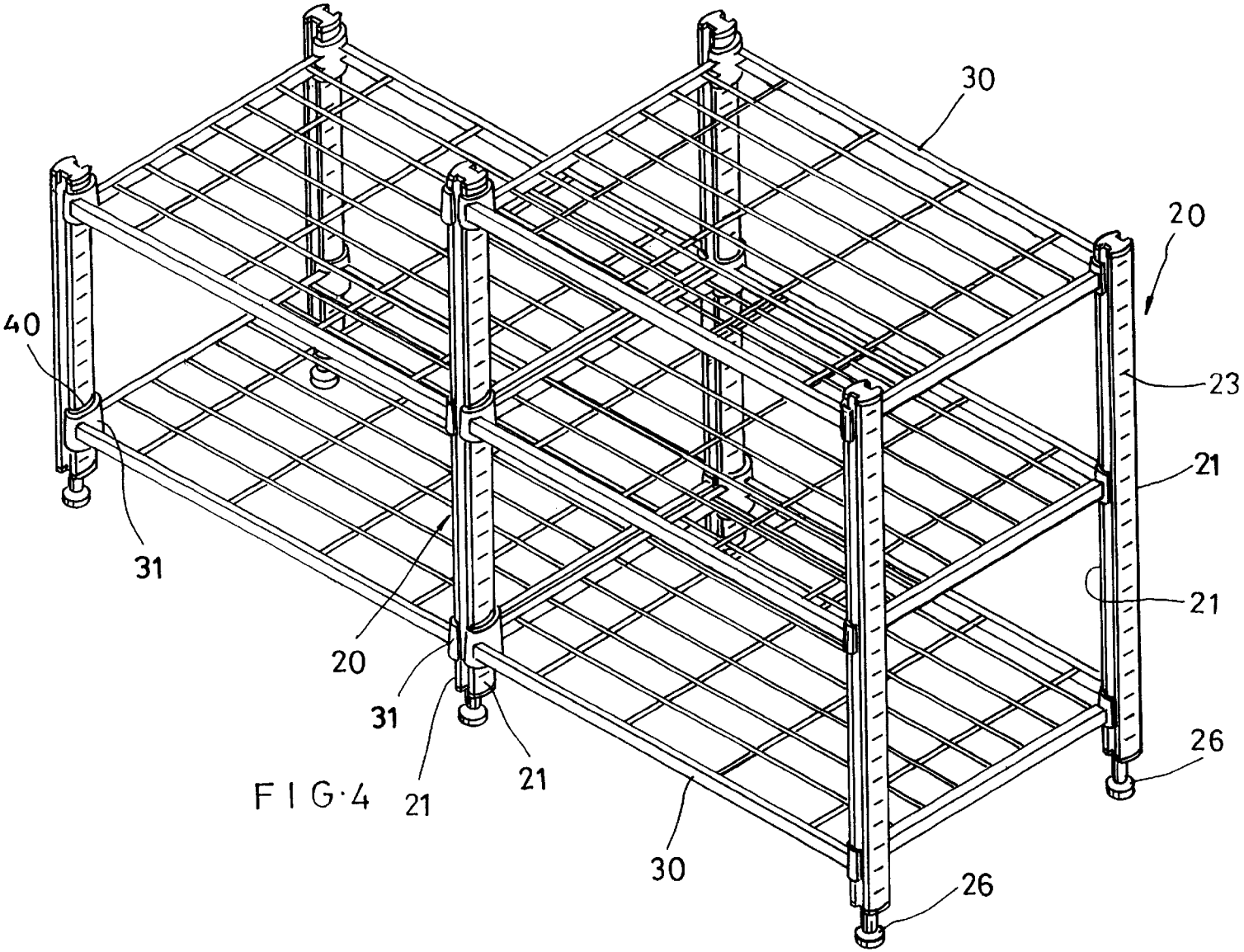
FIG. 4 is an assembled perspective of a sectional rack according to an embodiment of the present invention.

Please refer to FIG. 4 that is an assembled perspective of a sectional rack according to an embodiment of the present invention. As shown, the sectional rack is assembled mainly from a plurality of vertical posts 20, a plurality of horizontal shelves 30, and a plurality of connecting members 40.

Figure 5:
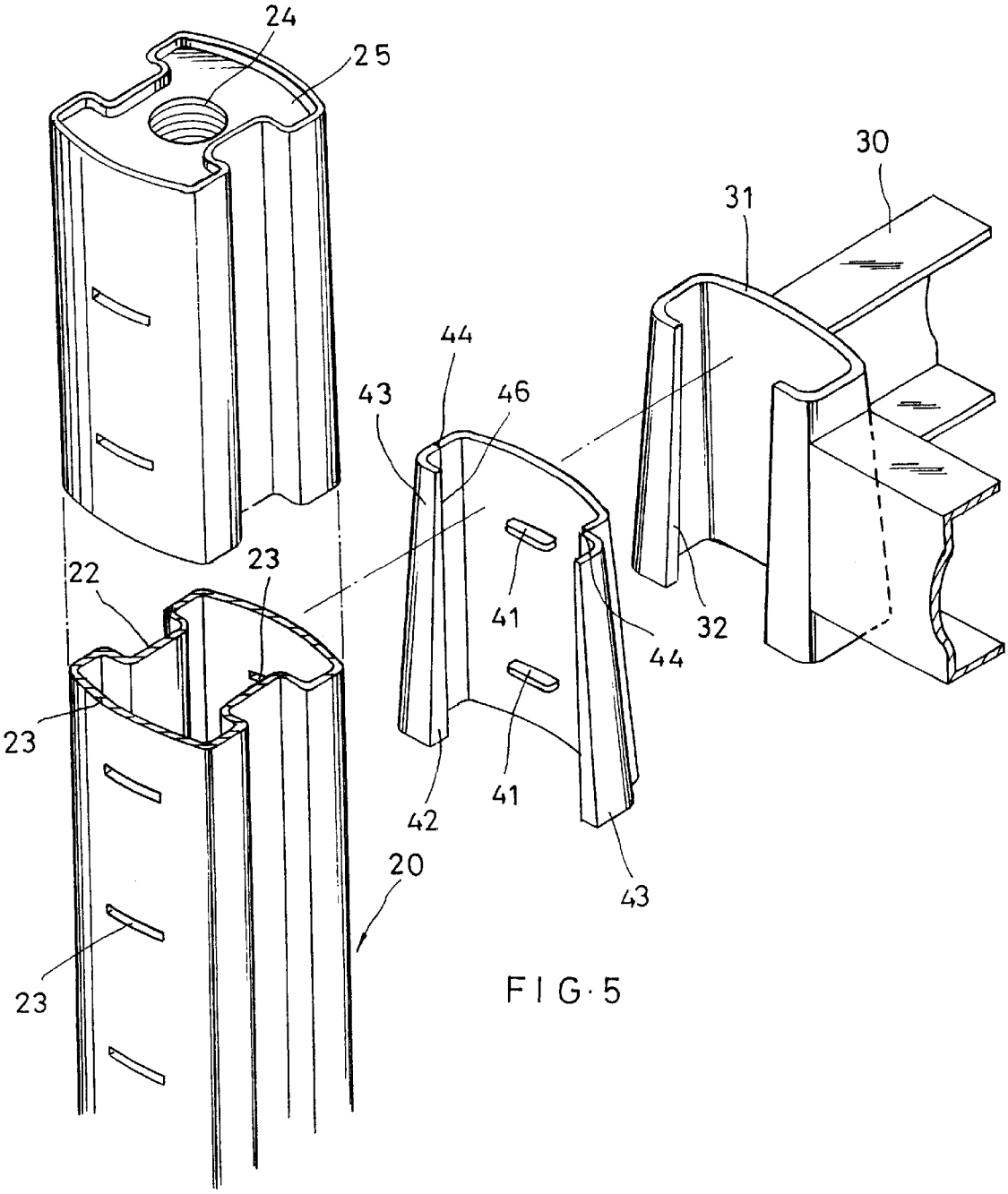
FIG. 5 is a fragmentary, enlarged and exploded perspective of the sectional rack of FIG. 4.

Please now refer to FIGS. 4 and 5 at the same time. Each vertical post 20 each is a hollow post and has a generally I-shaped cross section with two substantially rectangular and width-expanded side portions 21 and a width-narrowed middle portion 22 extending between the two side portions 21. The side portions 21 are provided along their length with a plurality of equally spaced horizontal slots 23. Each connecting member 40 each has a generally U-shaped cross section with two free ends 43 thereof bent inward toward each other. An inner surface of the connecting member 40 has a profile corresponding to the profile of an outer surface of the side portion 21 of the post 20, and is provided at a middle portion with one or two ribs 41 suitable for engaging into the slots 23 on the side portion 21, so that the connecting member 40 is adapted to fitly attach to the outer surface of the side portion 21. An outer surface of the connecting member 40 tapers from bottom to top. The horizontal shelf 30 each includes four short sleeves 31 connected to four corners thereof. The short sleeve 31 each has a generally U-shaped cross section with a side opening 32 thereof facing outward and has an inner surface tapered from bottom to top, so that the short sleeve 31 is adapted to embrace the connecting member 40 engaged onto the vertical post 20 and to apply a downward and inward pressure on the connecting member 40 to cause the latter to firmly attach to the side portion 21 of the post 20, and therefore enables the horizontal shelf 30 to stably connect to the vertical posts 20, as shown in FIGS. 6 and 7.

A side opening 42 of the U-shaped connecting member 40 between the two free ends 43 thereof has a width slightly larger than an overall width of the middle portion 22 of the vertical post 20, so that the two free ends 43 of the connecting member 40 would not be undesirably compressed against the middle portion 22 when the connecting member 40 is attached to and engaged onto the vertical post 20. A middle outer surface of the connecting member 40 opposite to the inner surface at where the ribs 41 are provided has a larger gradient than other portions of the connecting member 40 and this enables the short sleeve 31 of the horizontal shelf 30 to produce a more effective compression on the connecting member 40.

Moreover, to enable easy attachment of the connecting member 40 to the vertical post 20 via two lateral sides thereof, each lateral wall of the U-shaped connecting member 40 is vertically cut at predetermined position into two parts that are connected to each other by a thin material 44 provided at inner surface of the lateral wall. When the connecting member 40 is to be attached to or detached from the side portion 21 of the vertical post 20, simply pull the free ends 43 of the connecting member 40 outwardly for the two lateral walls to pivotally turn about the thin materials 44 and thereby widen the opening 42 to an extent large enough for the lateral walls to easily pass the width-expanded side portion 21 of the post 20. To enhance connection of the two cut portions of each lateral wall of the connecting member 40, it is possible to provide corresponding holes and protuberances (not shown) on the contacting surfaces of these cut portions.

Figure 6:
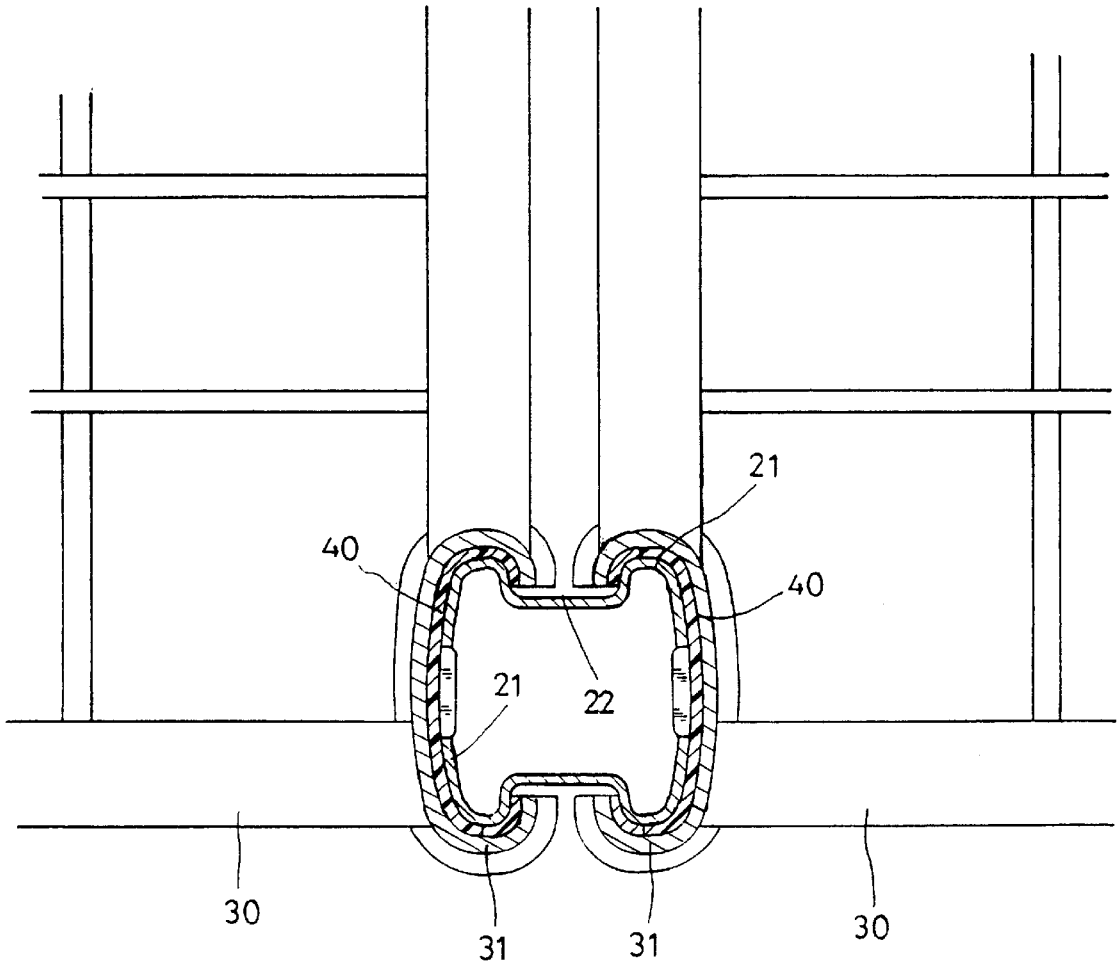
FIG. 6 is a fragmentary, enlarged and assembled cross sectional view of the sectional rack of FIG. 4.
Figure 7:
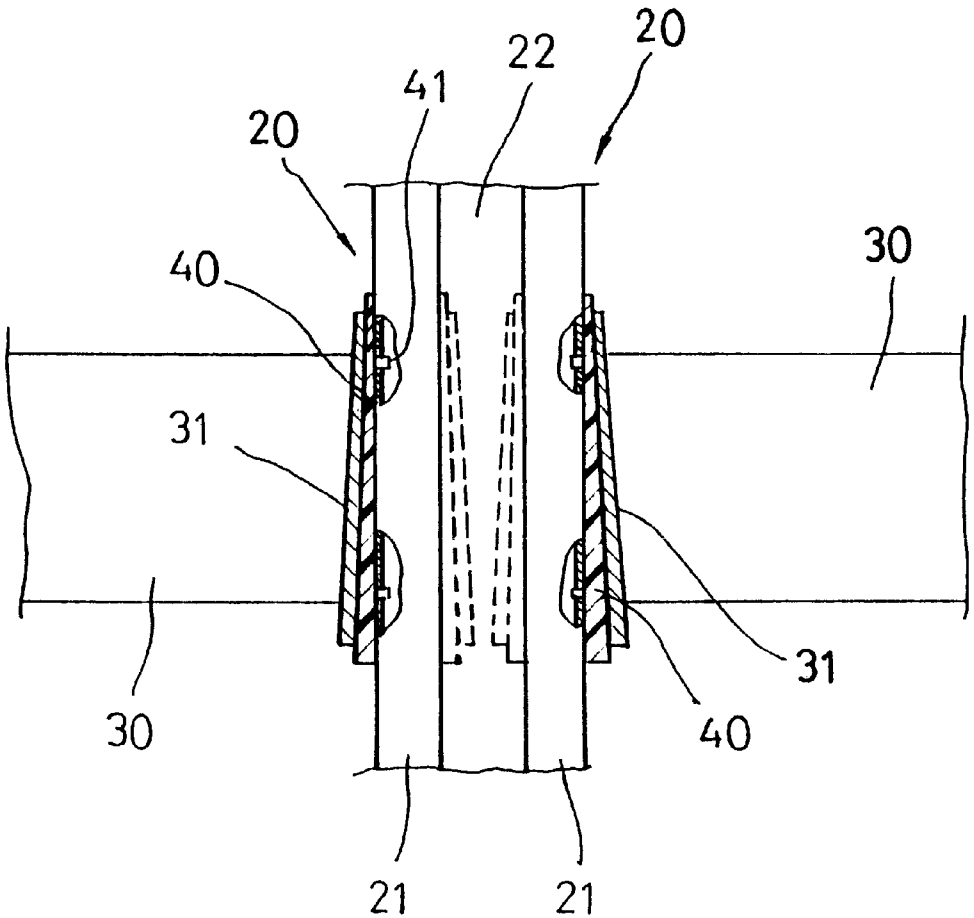
FIG. 7 is a fragmentary, enlarged and assembled vertical sectional view of the sectional rack of FIG. 4.

FIGS. 6 and 7 are cross and vertical sectional views, respectively, showing the connection of the connecting member 40 to the side portion 21 of the vertical post 20 and the connection of the short sleeve 31 to the connecting member 40. As shown, the ribs 41 projected from inner surface of the connecting member 40 are extended through slots 23 provided on the side portion 21, and the lateral walls and the free ends 43 separately, fitly embrace the side portion 21. The short sleeve 31 of the horizontal shelf 30 is seated on outer surface of the connecting member 40 to downwardly and inwardly compress the latter against the side portion 21 of the post 20. Since the side portions 21 are preferably symmetrically provided at two sides of the post 20, similar procedures are employed to connect the connecting members 40 and the short sleeves 31 to both side portions 21 of the post 20. The middle portion 22 defines on the post 20 two opposite channels large enough for each to receive free ends of two opposite connecting members 40 and of two opposite short sleeves 31 without causing these free ends, at two opposite sides, to interfere with one another. As a result, horizontal shelves 30 could be supported on two sides of the vertical post 20 at the same level, as shown in FIG. 4. That is, shelves 30 that are to be laterally extended from two sides of the posts 20 may be located at the same height to provide a large area of fully horizontal surface on the rack assembled from the posts 20, the shelves 30, and the connecting members 40. The horizontal surface in large area is, of course, more convenient for holding things thereon and creates a visually balanced and pleasant scene.

Figure 8:
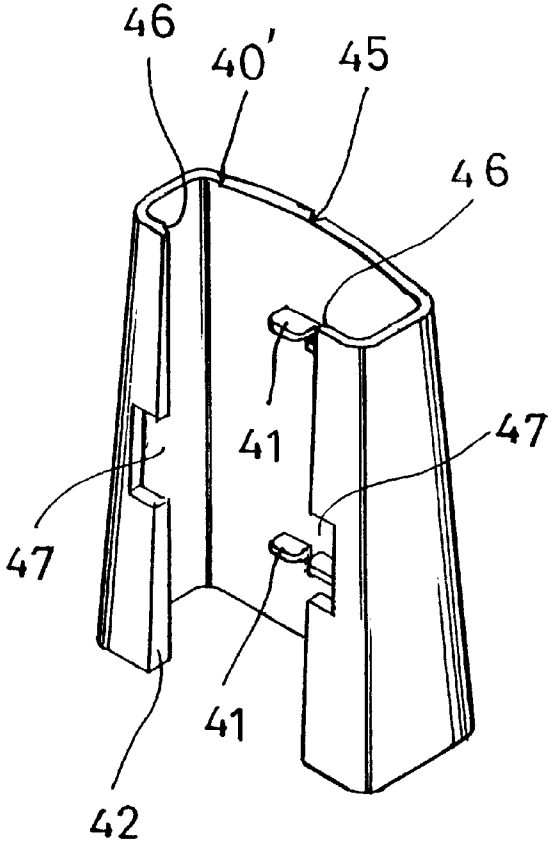
FIG. 8 is a perspective of another embodiment of the connecting member of the present invention.
Figure 9:
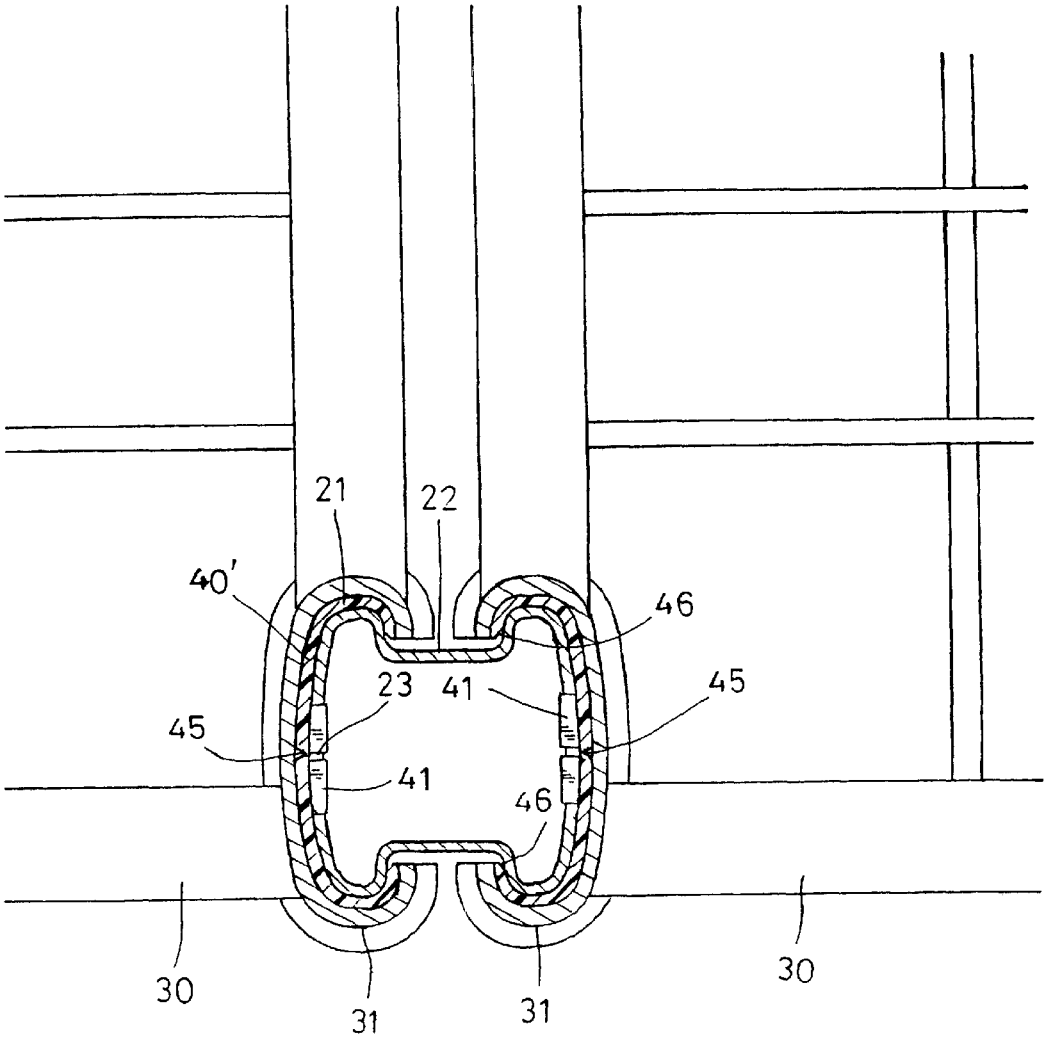
FIG. 9 is a fragmentary, enlarged, and assembled cross sectional view of the sectional rack of the present invention with the connecting member of FIG. 8.

In FIG. 8, there is shown another embodiment of the connecting member 40'. The connecting member 40 ' of this second embodiment is generally the same as that shown in FIG. 5, except that it is vertically cut along a centerline thereof into two parts instead of being cut at the lateral walls. A thin material 45 is used to connect the two cut parts together, so that the connecting member 40 ' may be bent outwardly about the thin material 45 to widen the side opening 42 and facilitate attachment of the connecting member 40 to the side portion 21 of the post 20. It is possible to provide a rounded inner edge 46 for each free end of the U-shaped connecting member 40 for the lateral walls thereof to smoothly pass two sides of the side portion 21 to embrace the same. FIG. 9 shows the connection of the connecting member 40 of FIG. 8 to the side portion 21 of the post 20. Moreover, to enable easy removal of the connecting member 40 from the post 20, two notches 47 may be separately provided at the two free ends of the connecting member 40 '. An operator may easily apply force at the notches 47 to pull open the lateral walls of the connecting member 40'. In this second embodiment of connecting member 40', the ribs 41 provided on inner surface thereof are correspondingly cut into two parts to locate at two sides of the thin material 45.

The side opening 32 of the short sleeve 31 defines a width slightly larger than the overall width of the middle portion 22 of the post 20, so that two free ends of the U-shaped short sleeve 31 would not be undesirably compressed against the middle portion 22 when the short sleeve 31 embraces the connecting member 40 and the side portion 21.

Figure 10:
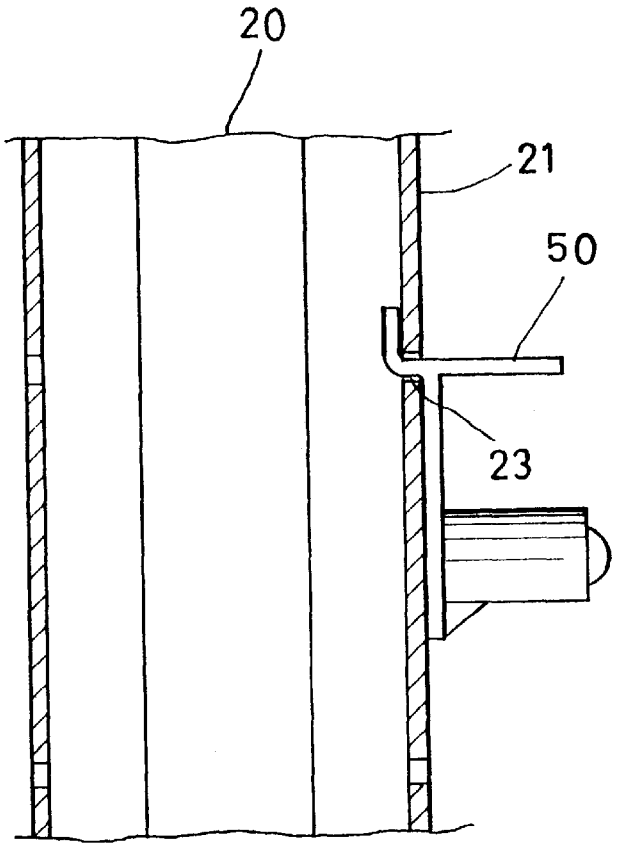
FIG. 10 is a fragmentary and enlarged vertical sectional view of the post of the rack of the present invention with another type of hanger hooked thereto.

The slots 23 provided on the side portions 21 of the post 20 may also be replaced with horizontal grooves (not shown) provided at outer surfaces of the side portions 21 to provide the same function of receiving and locating the ribs 41 in place. However, provision of the slots 23 on the side portions 21 facilitates hooking of other type hangers 50 on the slots 23, as shown in FIG. 10, so that other means for holding things, such as a basket or other smaller rack (not shown) may be additionally attached to the sectional rack of the present invention.

Upper and lower ends of the hollow post 20 may be separately sealed with an insert 25 having a central threaded hole 24. Connecting means (not shown) may be screwed to the holes 24 at the upper end to connect two posts 20 together. Or, a leg 26 or a caster (not shown) may be screwed to the hole 24 at the lower end of a post 20.

In conclusion, the sectional rack according to the present invention is characterized in that the horizontal shelves 30 can be supported on two sides of a post 20 at the same height to make the rack assembled from the posts 20 and the shelves 30 visually more attractive.

What is claimed is:

1. A sectional rack comprising a plurality of vertical posts, a plurality of horizontal shelves, and a plurality of connecting members;

each of said vertical posts being a hollow post and having a generally I-shaped cross section with two substantially rectangular and width-expanded side portions and a width-narrowed middle portion extending between said two side portions, said side portions being provided along their length with a plurality of equally spaced horizontal slots;

each of said connecting members having a generally U-shaped cross section with two free ends thereof bent inward toward each other, an inner surface of said connecting member having a profile corresponding to that of an outer surface of said side portion of said post, and being provided with one or two ribs suitable for engaging into said slots on said side portion, so that said connecting member is adapted to fitly attach to the outer surface of said side portion, and an outer surface of said connecting member tapering from bottom to top; and each of said horizontal shelves including four short sleeves connected to four corners thereof, said short sleeve each having a generally U-shaped cross section with a side opening thereof facing inward and having an inner surface tapered from bottom to top, so that said short sleeve is adapted to embrace said connecting member engaged onto said vertical post and to apply a downward and inward pressure on said connecting member to cause the latter to firmly attach to said side portion of said post, and therefore enables said horizontal shelves to stably connect to said vertical posts.

2. A sectional rack as claimed in claim 1, wherein said side opening of each said short sleeve of said horizontal shelf has a width slightly larger than an overall width of said middle portion of said vertical post.

3. A sectional rack as claimed in claim 1, wherein each of said connecting members has a side opening defined between said two free ends thereof and said side opening has a width slightly larger than an overall width of said middle portion of said vertical post.

4. A sectional rack as claimed in claim 3, wherein each lateral wall of said U-shaped connecting member is vertically cut at a predetermined position into two parts that are connected to each other by a thin material to facilitate easy turning of said lateral wall about said thin material to widen said side opening of said connecting member.

5. A sectional rack as claimed in claim 3, wherein a middle wall of said U-shaped connecting member is vertically cut along a centerline thereof into two parts that are connected to each other by a thin material to facilitate easy turning of said connecting member about said thin material to widen said side opening of said connecting member.

6. A sectional rack as claimed in claim 5, wherein each of said ribs provided at the inner surface of said connecting member is correspondingly cut into two parts to locate at two sides of said thin material connecting said two parts of said connecting member.

7. A sectional rack as claimed in claim 5, wherein each of said lateral walls of said connecting member is provided at their free ends at predetermined position with a notch.

* * * * *